United States Patent [19]

Skoch et al.

[11] Patent Number: 4,928,032

[45] Date of Patent: May 22, 1990

[54] MEANS FOR CONVERTING A LAMP WITH A SCREW-TYPE BASE INTO A LAMP WITH A BI-PIN BASE

[75] Inventors: Michael J. Skoch, Mentor; Frederick Hetzel, Brook Park, both of Ohio

[73] Assignee: General Electric Company, Schenectady, N.Y.

[21] Appl. No.: 331,554

[22] Filed: Mar. 31, 1989

[51] Int. Cl.[5] ..... H01J 5/50; H01R 33/02; H01R 13/58; H01R 17/00

[52] U.S. Cl. ..... 313/318; 439/242; 439/243; 439/605; 439/611

[58] Field of Search ..... 313/318; 439/188, 236, 439/242, 243, 244, 605, 611, 616, 617, 619, 650

[56] References Cited

U.S. PATENT DOCUMENTS 3,019,407 1/1962 Donsky ..... 439/611 X
3,217,116 11/1965 Martin et al. ..... 200/51.03
3,915,536 10/1975 Glantz ..... 439/188

*Primary Examiner*—Sandra O'Shea
*Attorney, Agent, or Firm*—Edward M. Corcoran; Stanley C. Corwin; Fred Jacob

[57] ABSTRACT

For converting a lamp with a screw-type base into a lamp with a bi-pin base, there is provided a cup-shaped adapter of electrical insulating material comprising a tubular body containing a bore that has internal threads threadedly receiving the external threads on the usual metal shell of the screw-type base. The adapter further comprises an end wall extending across the bore at one end of the tubular body and carrying two conductive pins extending through the end wall in laterally-spaced relation. First conductor within the adapter connected to one pin has a free end that engages the usual coniform end of the metal shell when the base is threaded into said bore, thereby establishing an electrical connection between the metal shell and said one pin. Second conductor connected to the other pin establishes an electrical connection between the usual eyelet of the base and the other pin when the base is threaded into said bore.

14 Claims, 2 Drawing Sheets

Fig. 2
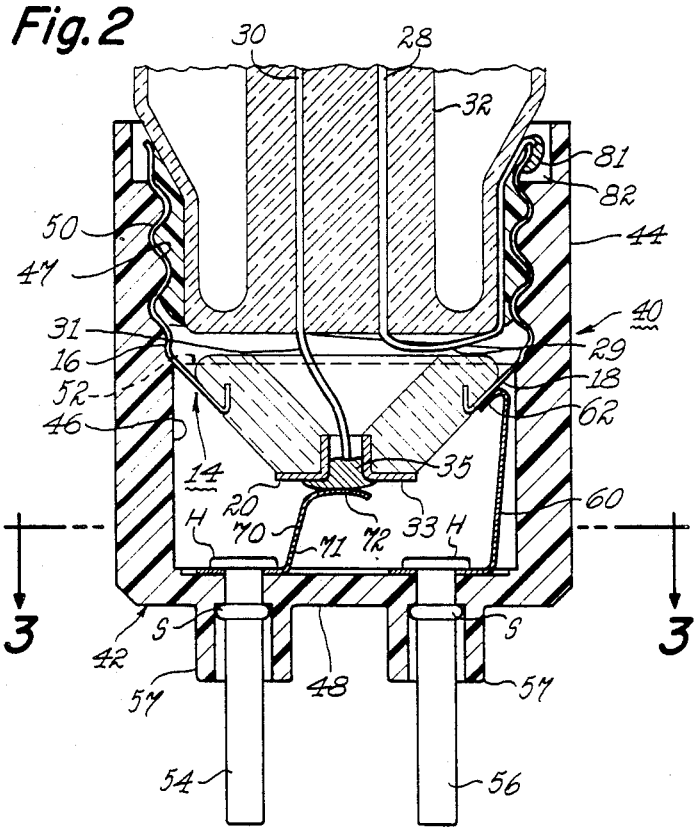
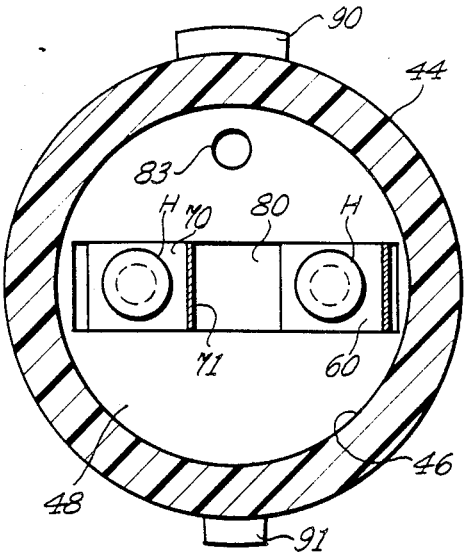
Fig. 3

MEANS FOR CONVERTING A LAMP WITH A SCREW-TYPE BASE INTO A LAMP WITH A BI-PIN BASE

This invention relates to means for converting a lamp with a screw-type base into a lamp with a bi-pin base and, more particularly, relates to conversion means of this type which is simple, inexpensive, and capable of being applied for use at elevated voltages and temperatures, e.g., at voltage ratings of 4KV peak surge voltage and at temperature ratings of 200° C. developed at the base.

BACKGROUND

For certain lighting applications, it is common practice in a number of different countries to utilize lamps having a bi-pin type of base. In the usual design of such lamps, the bi-pin base is included as an integral part of the lamp. In the United States, lamps for the same applications are typically made with a screw-type base, and this normally renders them unsuitable for use in locations where the sockets for such applications are designed for reception of the bi-pin base. It would be highly advantageous, avoiding !he need for specialized new lamp-making machinery, if screw-type lamp bases of existing design could be used with sockets designed for pin-type bases.

OBJECTS

Accordingly, an object of my invention is to provide a simple conversion unit which can be easily and inexpensively applied to a lamp with a screw-type base to convert it into a lamp with a pin-type base.

Another object is to provide an inexpensive conversion unit of this type which is suitable for application at elevated voltages and temperatures, e.g., at voltage ratings of 4KV peak surge voltage and at temperature ratings of 200° C. developed at the base.

Another object is to prevent an individual from coming into contact with live parts of the conversion unit when the lamp is energized through a bi-pin-receiving socket and, more specifically, to accomplish this in a way that does not interfere with good electrical contact between the screw-type base and conductive contact means within the conversion unit.

SUMMARY

In carrying out the invention in one form, I provide conversion means that comprises a cup-shaped adapter comprising: (i) a tubular body containing a bore that extends between opposite ends of the tubular body and (ii) an end wall extending across the bore at one end of the tubular body. The bore is open at its opposite end and contains internal threads for threadedly receiving the externally-threaded metal shell of a screw-type lamp base inserted into the bore through said open end. The end wall and the tubular body are of electrical insulating material. The conversion means further comprises two conductive pins extending through the end wall in laterally spaced-apart relationship. First conductive means within the adapter is provided for contacting the metal shell of the screw-type base and electrically connecting the shell to one of said pins when the shell is threaded into the internal threads. Also provided within the adapter is second conductive means, insulated from the first conductive means, for electrically connecting the usual centrally-disposed metal eyelet of the screw-type base to the other of said pins when the screw-type base is threaded into said internal threads. Bonding means between the metal shell and the adapter is provided for blocking unscrewing of said shell from the adapter, thereby preventing exposure of said conductive means while said pins are energized. The first conductive means is so located that it contacts the metal shell in a location where the shell is free of said bonding means.

BRIEF DESCRIPTION OF THE FIGURES OF THE DRAWING

For a better understanding of the invention, reference may be had to the following description of an embodiment of the invention, taken in conjunction with the accompanying drawing, wherein:

FIG. 2 is an enlarged sectional view of a conversion base for use in converting the lamp of FIG. 1 to a lamp with a bi-pin base.

FIG. 3 is a sectional view along the line 3—3 of FIG. 2.

DETAILED DESCRIPTION OF EMBODIMENT

Figure 1:
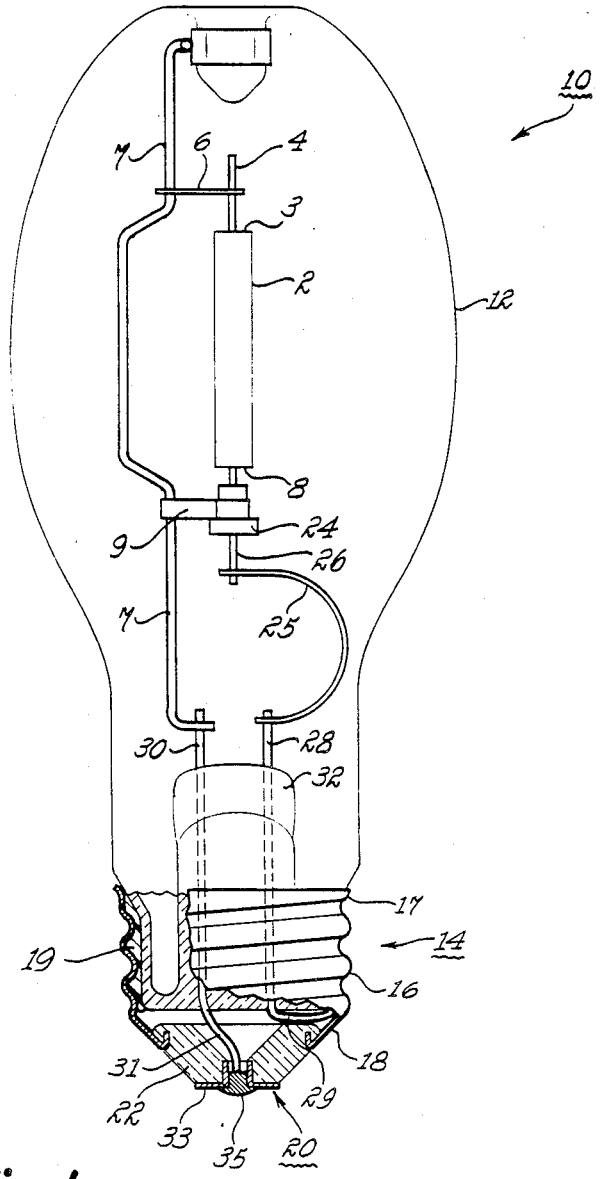
FIG. 1 is a side elevational view partly in section of a conventional lamp having a screw-type base.

Referring now to FIG. 1, there is shown a prior art lamp 10 that comprises a glass envelope 12 and a conventional screw-type base 14. The screw-type base 14 comprises an externally-threaded shell 16 of thin-gauged metal having a generally cylindrical upper end 17 and a coniform lower end 18. The shell surrounds the lower end of the glass envelope 12 and is suitably joined thereto, as by cement 19. The coniform lower end 18 of the shell is used for supporting a centrally located eyelet 20. Between the eyelet 20 and the lower end 18 of the shell is a glass ring 22 of coniform shape suitably joined at its inner and outer peripheries to the eyelet 20 and the lower end 18 of the shell, respectively. The glass ring 22 provides electrical insulation between the eyelet and the shell.

In one form of the invention, the lamp 10 is a high pressure sodium gas-discharge or arc lamp. As shown in FIG. 1, this lamp comprises an inner envelope or arc tube 2, centrally located within the outer envelope 12 and comprising a closed length of light-transmitting polycrystalline alumina ceramic tubing, which is translucent. The upper end of this arc tube 2 is hermetically sealed by a polycrystalline alumina end closure member 3, through which extends a niobium inlead wire 4 also hermetically sealed to said end closure member, which supports an electrode (not shown) contained within the arc tube. The external portion of in-lead 4 connects to a transverse conductive support member 6 attached to a side rod member 7. A lower end closure member 8 for arc tube 2 has a central aperture through which extends a bottom electrode (not shown). The hermetically sealed arc tube is physically supported in the outer envelope by a metal ribbon 9 which is welded to side rod 7, but electrically isolated from the arc tube by an insulating bushing 24. A conductive lead 25 is electrically connected to a niobium in-lead wire 26 for the lower electrode.

The arc tube 2 contains a mercury-sodium amalgam together with a starting gas; and the establishment of an arc between its electrodes vaporizes the amalgam, thus producing the characteristic light output of the sodium vapor arc that is transmitted through the translucent tube 2, all in a conventional manner.

Two relatively heavy lead-in conductors 28 and 30 are provided for connecting the lamp electrodes in an external circuit. These lead-in conductors extend in sealed relationship through a reentrant stem press seal 32 of conventional form. The upper ends of the lead-in conductors 28 and 30 are respectively connected to the conductive lead 25 and the conductive side rod member 7. One of the leads 28 has a lower end 29 suitably connected to the metal shell 16, and the other lead 30 has a lower end 31 connected to the eyelet 20. A typical eyelet 20 comprises a ring 33 of L-shaped cross-section defining a cylindrical central region and a mass 35 of solder filling this central region and joining the lower end 31 of lead 30 to the eyelet.

While I have shown the invention in connection with a high pressure sodium arc lamp, it is to be understood that in its broader aspects the invention is applicable to other types of lamps having screw-type bases, e.g., incandescent lamps and metal halide lamps.

As pointed out hereinabove, an object of the invention is to adapt a lamp with a screw-type base, such as shown in FIG. 1, for use with a socket that receives only a bi-pin type base. To this end, I provide a conversion unit or base 40 of the type illustrated in FIG. 2. This conversion base comprises a cup-shaped adapter 42 comprising a tubular body 44 containing a bore 46 that extends between opposite ends of the tubular body. The cup-shaped adapter 42 further comprises an end wall 48 that extends across the bore 46 at the lower end of the tubular body 44. The upper end of the bore 46 is open so that the screw-type base 14 of the lamp of FIG. 1 can be inserted into the bore.

The bore 46 contains internal threads 47 for threadedly receiving the external threads 50 on the shell 16 of the lamp base 14. When base 14 is inserted into the bore 46 and its shell 16 is threaded into threads 47, the shell moves downwardly until its coniform lower end encounters a positive stop 52 in the form of an annular shoulder on bore 46 that blocks further downward motion of the base.

The conversion base 40 further comprises two metal pins 54 and 56 extending downwardly through the end wall 48 in laterally-spaced relationship. These pins at their lower ends are adapted to make contact with female contacts (not shown) of a conventional pin-receiving socket. Surrounding each pin in radially-spaced relation is a sleeve 57 that is integral with the end wall 48 of the conversion base. These sleeves assure that good electrical insulation is maintained between the pins 54 and 56 on the external surface of the end wall 48 and also serve as guides for the conversion base when the pins 54 and 56 are being moved downwardly into the receiving socket (not shown).

When the screw-type base 14 is threaded into the conversion base 40, at a point near the end of the downward travel of the screw-type base, a first electrical connection is established between the shell 16 and the metal pin 56, and a second electrical connection is established between the eyelet 20 and the other pin 54. The first electrical connection is established through an L-shaped brass strip 60 that has a horizontal arm connected to pin 56 and a resilient vertical arm having an upper end comprising a bent-over portion 62 adapted to engage the coniform lower end 18 of the shell 16. The second electrical connection is established through a second brass strip 70 of generally Z-shaped form having a lower arm connected to pin 54 and a resilient upper arm 71 having an upper end 72 adapted to engage the eyelet 20 of the base 14. Initial engagement of the strips 60 and 70 with the portions 20 and 18 of the screw-type base 40 occurs prior to the point at which the stop 52 is encountered by the shell portion 16, 18 of the screw-type base. After such initial engagement occurs, the screw-type base 14 is screwed further into the conversion unit until stop 52 is engaged. This additional downward motion of base 14 causes the resilient arms of the strips 60 and 70 to flex slightly, producing good electrical contact between the upper ends of the resilient arms and the base components 20 and 18. Flexing of the central strip 70 is sufficiently limited as to maintain enough clearance between the two strips to withstand rated voltage applied between the two pins 54 and 56.

In the illustrated embodiment, the connection between the lower end of each of the conductive strips 60 and 70 and its associated pin is formed by upsetting the top of the pin in rivet-head fashion and forcing the resulting head H into good electrical contact with the strip. As seen in FIG. 3, each strip has a hole therein through which the pin projects, and the head H of the pin extends around the entire peripheral region of this hole. Each pin has a shoulder S thereon positioned below the end wall 48; and when the head H is formed on the pin, the associated strip and the end wall 48 are sandwiched together between the head H and the shoulder S, establishing a good long-life electrical contact between the head H and the strip.

Referring to FIG. 3, it is noted that the lower arm of each of the strips 60 and 70 is located in a shallow groove 80 in the end wall 48, and this assures that the strip will not be pivotally displaced about its associated pin.

In a preferred embodiment of the invention, the cup-shaped adapter 42 is made of a polymeric material capable of withstanding high temperatures, e.g., 300° C., without damage or deterioration. An example of such a material is the liquid crystal polymer marketed by Celanese Corp. as its VECTRA A·130 polymer. Preferably, the adapter is injection molded from this polymer. A typical high pressure sodium lamp, such as the illustrated lamp 10, operating within its rating, develops much higher temperatures at its base than the usual incandescent lamp operating within its rating. For high pressure sodium lamps, the base temperature may rise to as high as 200° C. compared to less than 100° C. for the typical incandescent lamp. Since the polymer that I utilize can withstand temperatures as high as 300° C., it is capable of safely withstanding the maximum temperatures anticipated even with high pressure sodium lamps.

Although most other plastic materials would not be suitable for the adapter 42 because of their inability to withstand these high temperatures, certain ceramic materials could be used. These ceramics, however, have the disadvantage of being quite expensive. In addition, one cannot achieve the same high degree of dimensional precision with ceramics as one can with the liquid crystal plastic.

To assure that the conductive strips 60 and 70 do not become exposed and subject to possible accidental touching when the conversion base is plugged in and the pins 54 and 56 are energized, the lamp 10 is made effectively non-removable from the conversion base 40. This is accomplished by bonding the threaded metal shell 16 to the tubular body 44 of the adapter by means of an adhesive applied to the external threads 50 of the shell before it is threaded into the conversion base. An adhesive suitable for this purpose is the adhesive marketed by Loctite Corporation of Newington, Conn. as its RC/620 adhesive. This is an anaerobic bonding material that cures at room temperature. At the factory, a bead of this adhesive is applied to the external threads 50 of the shell 16 of the completed lamp just before the base 14 is threaded into the conversion base 40. After such threading, the adhesive quickly cures at room temperature, bonding the external threads 50 of the shell to the internal threads 47 of the tubular body 44. Upon curing, this adhesive is capable of withstanding without deterioration the relatively high temperatures developed in this region during lamp operation, thus precluding unscrewing of the lamp from the conversion base for the life of the lamp.

The above-described adhesive bead is applied preferably around the entire periphery of the shell 16 and at a point just above the lowermost turn of the external thread 50. This results, after threading, in a thin layer of adhesive covering almost all of the external threads 50 except for the lowermost turn. In the completed assembly, no adhesive extends beyond the lowermost turn, thus leaving the coniform portion 18 of the base clean and free of adhesive, thereby enabling good electrical contact to be made and maintained between the upper end 62 of the conductive strip 60 and the coniform portion 18 of screw base 14.

Another safety feature is that the conversion base 40 completely covers the metal shell 16 of the screw-type base 14. This further reduces the chances that anyone will accidentally contact live parts of the lamp while the lamp is energized.

To assure that the lamp base 14 can be fully threaded into the conversion base without significant interference, the bore 46 at its top end is made slightly larger than the external diameter of the metal shell 16 at its top end. The resulting clearance, shown at 82 in FIG. 2, allows the usual small solder nugget 81 on the exterior of the screw base to freely enter the bore 46, thus preventing this solder nugget from interfering with full insertion of the base 14 into the bore 46.

As shown in FIG. 3, the end wall 48 of the cup-shaped adapter 42 contains a pressure-relief hole 83 for relieving the interior of the adapter from undesirable pressure build-ups as a result of rapid temperature rises therein. The presence of the adhesive bonding between threads 47 and 50 precludes venting that might otherwise have occurred through normal clearance spaces between the threads if no adhesive were present. In accordance with another embodiment of my invention, the pins 54 and 56 are made hollow to allow for venting through the resulting passages in the pins.

For assuring a predetermined polarity of the pins 54 and 56 when the completed assembly of the lamp 10 and its bi-pin base 40 is inserted into the pin-receiving socket (not shown), suitable lugs 90 and 91 of different size are provided on the external periphery of the base, as shown in FIG. 3. These lugs cooperate in a conventional manner with correspondingly sized slots (not shown) in the socket to assure that the base is correctly inserted into the socket to provide the desired polarity of the pins.

While I have shown and described a particular embodiment of my invention, it will be obvious to those skilled in the art that various changes and modifications may be made without departing from my invention in its broader aspects; and I, therefore, intend herein to cover all such changes and modifications as fall within the true spirit and scope of my invention.

What I claim as new and desire to secure by Letters Patent of the United States is:

1. Conversion means for converting a lamp with a screw-type base into a lamp with a bi-pin base, the screw-type base comprising an externally threaded conductive shell having a coniform outer end, a conductive eyelet at one end of the screw-type base disposed centrally of the coniform outer end of said shell, and electrical insulation between the coniform outer end of the shell and the eyelet; said conversion means comprising:

(a) a cup-shaped adapter comprising: (i) a tubular body containing a bore that extends between opposite ends of said tubular body and (ii) an end wall extending across said bore at one end of said tubular body, said bore being open at the opposite end of said tubular body and containing internal threads for threadedly receiving the externally-threaded shell of a screw-type base inserted into said bore through said open end, said end wall and said tubular body being of electrical insulating material, (b) two conductive pins extending through said end wall in laterally spaced-apart relationship and supported on said end wall, (c) first conductive means within said adapter for electrically connecting the shell of said screw-type base to one of said pins when said shell is threaded into said internal threads, said first conductive means comprising conductive structure that is electrically connected to said one pin and has a free end that is engageable by said coniform outer end of said shell when said shell is threaded into said internal threads, thereby establishing electrical contact between said free end and said coniform outer end, (d) second conductive means within said adapter and electrically insulated from said first conductive means for electrically connecting the eyelet of said screw type base to the other of said pins when the shell of said screw-type base is threaded into said internal threads.

2. The conversion means of claim 1 in which said first conductive means further comprises means for biasing said free end of said conductive structure into good electrical contact with said coniform outer end of said shell.

3. Conversion means as defined in claim 1 and further including bonding means between the external threads of said shell and the internal threads of said tubular body for blocking unscrewing of said shell from said adapter.

4. The combination of claim 1 in which said first conductive means further comprises means for biasing said free end of said conductive structure into good electrical contact with said coniform outer end of said shell.

5. The combination as defined in claim 1 and further including bonding means between the external threads of said shell and the internal threads of said tubular body for blocking unscrewing of said shell from said adapter.

6. Conversion means for converting a lamp with a screw-type base into a lamp with a bi-pin base, the screw-type base comprising an externally threaded conductive shell, a conductive eyelet at one end of the screw-type base disposed centrally of said shell, and electrical insulation between the shell and the eyelet; said conversion means comprising:

(a) a cup-shaped adapter comprising: (i) a tubular body containing a bore that extends between opposite ends of said tubular body and (ii) an end wall extending across said bore at one end of said tubular body, said bore being open at the opposite end of said tubular body and containing internal threads for threadedly receiving the externally-threaded shell of a screw-type base inserted into said bore through said open end, said end wall and said tubular body being of electrical insulating material, (b) two conductive pins extending through said end wall in laterally spaced-apart relationship and supported on said end wall, (c) first conductive means within said adapter for electrically connecting the shell of said screw-type base to one of said pins when said shell is threaded into said internal threads, (d) second conductive means within said adapter and electrically insulated from said first conductive means for electrically connecting the eyelet of said screw type base to the other of said pins when the shell of said screw-type base is threaded into said internal threads, and (e) adhesive bonding means between said shell and said adapter for blocking unscrewing of said shell from said adapter, and in which:

(f) said first conductive means comprises a first conductive member within said adapter connected to said one pin for engaging said shell at a location free of said adhesive bonding means when the shell is threaded into said internal threads, and (g) said second conductive means comprises a second conductive member within said adapter connected to said other pin for engaging said eyelet when the shell is threaded into said internal threads.

7. The conversion means of claim 6 in which:

(a) said first conductive member includes a resilient portion that biases one end of said first conductive member into good electrical contact with said shell when engagement is established between said one end and said shell, and (b) said second conductive member includes a resilient portion that biases one end of said second conductive member into good electrical contact with said eyelet when engagement is established between said one end of the second conductive member and said eyelet.

8. The conversion means of claim 6 in which:

(a) said adhesive bonding means comprises an adhesive located between the external threads of said shell and the internal threads of said tubular body, and (b) said first conductive member engages said shell at a location spaced from said external threads.

9. The conversion means of claim 6 in which:

(a) the internal threads in said tubular body are of the insulating material of said body, and (b) the external threads on said conductive shell mate with said internal threads of insulating material.

10. The conversion means of claim 9 in which:

(a) said adhesive bonding means comprises an adhesive located between the external threads of said shell and the internal threads of said tubular body, and (b) said first conductive member engages said shell at a location spaced from said external threads.

11. Conversion means as defined in claim 6 for a lamp having a screw-type base comprising a solder nugget externally of said shell at an end of the shell nearest the glass envelope of the lamp, wherein: the bore of said adapter has a diameter adjacent the open end thereof that is larger than the threaded portion of said bore so as to provide a clearance space around said shell for freely receiving said nugget.

12. In combination, (a) a high pressure sodium arc lamp comprising: (i) a glass envelope within which a sodium vapor arc is developed during lamp operation and (ii) a screw-type base joined to said envelope, said screw-type base comprising a conductive shell having external threads and a coniform outer end, a conductive eyelet at one end of the screw-type base disposed centrally of the coniform outer end of the shell, and electrical insulation between said coniform outer end and said eyelet, (b) a cup-shaped adapter comprising: (i) a tubular body containing a bore that extends between opposite ends of said tubular body and (ii) an end wall extending across said bore at one end of said tubular body, said bore surrounding said shell and containing internal threads for threadedly receiving the external threads on said shell, said end wall and said tubular body being of electrical insulating material, (c) two conductive pins extending through said end wall in laterally spaced-apart relationship and supported on said end wall, (d) first conductive means within said adapter for electrically connecting the shell of said screw-type base to one of said pins when said shell is threaded into said internal threads, said first conductive means comprising conductive structure that is electrically connected to said one pin and has a free end that is engageable by said coniform outer end of said shell when said shell is threaded into said internal threads, thereby establishing electrical contact between said free end and said coniform outer end, and (e) second conductive means within said adapter and electrically insulated from first conductive means for electrically connecting the eyelet of said screw-type base to the other of said pins when the shell of said screw-type base is threaded into said internal threads.

13. The combination of claim 12 in which the electrical insulating material of said end wall and tubular body is a polymeric material capable of withstanding without damage service temperatures of at least 200° C.

14. The combination of claim 13 in which said polymeric material is a liquid crystal polymer.

* * * * *